US007943277B2

(12) United States Patent
Molaire et al.

(10) Patent No.: US 7,943,277 B2
(45) Date of Patent: May 17, 2011

(54) SOL GEL OVERCOATS INCORPORATING ZINC ANTIMONATE NANOPARTICLES

(75) Inventors: Michel F. Molaire, Rochester, NY (US); Wayne T. Ferrar, Fairport, NY (US); Edward T. Miskinis, Rochester, NY (US); Michael W. Frauens, Webster, NY (US); William T. Gruenbaum, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 769 days.

(21) Appl. No.: 11/945,612

(22) Filed: Nov. 27, 2007

(65) Prior Publication Data

US 2009/0136859 A1 May 28, 2009

(51) Int. Cl.
*G03G 5/147* (2006.01)

(52) U.S. Cl. ..... 430/66; 430/58.2

(58) Field of Classification Search ..... 430/58.2, 430/66, 67

See application file for complete search history.

(56) References Cited

U.S. PATENT DOCUMENTS

| | | | | |
|---|---|---|---|---|
| 4,027,073 | A | 5/1977 | Clark | |
| 4,439,509 | A | 3/1984 | Schank | |
| 4,595,602 | A | 6/1986 | Schank | |
| 4,923,775 | A | 5/1990 | Schank | |
| 5,866,287 | A * | 2/1999 | Christian et al. | 430/63 |
| 5,874,018 | A | 2/1999 | Ferrar et al. | |
| 6,187,491 | B1 | 2/2001 | Ferrar et al. | |
| 6,365,309 | B1 | 4/2002 | Tokutake et al. | |
| 6,517,984 | B1 | 2/2003 | Ferrar et al. | |
| 7,289,751 | B2 | 10/2007 | Ito et al. | |
| 7,390,599 | B2 * | 6/2008 | Bender | 430/58.2 |
| 2006/0199092 | A1 | 9/2006 | Sugino et al. | |
| 2007/0015074 | A1 * | 1/2007 | Sugino et al. | 430/59.6 |

FOREIGN PATENT DOCUMENTS

| | | |
|---|---|---|
| EP | 1 246 016 | 10/2002 |

OTHER PUBLICATIONS

J.M.G. Cowrie et al., "Electrolytes Dissolved in Polymers", Annu. Rev. Phys. Chem., vol. 40, (1989) pp. 85-113.

D.F. Shriver et al., "Solid Ionic Conductors", Chemical and Engineering News, vol. 63, (1985) pp. 42-57.

J.S. Tonge et al., "Polymer Electrolytes", Chapter 5, Polymers for Electronic Applications, ed. J.H. Lai, CRC Press Boca Raton, Fla., (1989) pp. 157-210, at 162.

J.M. Crowrie, "Integration of Fundamental Polymer Science and Technology", vol. 2, Elsevior Publ., New York, (1988) pp. 54-62.

* cited by examiner

*Primary Examiner* — Christopher RoDee

(74) *Attorney, Agent, or Firm* — Carl F. Ruoff; Andrew J. Anderson

(57) ABSTRACT

The present invention is directed to an electrophotographic element that comprises: an electrically conducting layer, a charge generating layer overlying the electrically conducting layer, and a charge transport layer overlying the electrically conducting layer. The charge transport layer, which can be an overcoat overlying the charge generating layer, includes the reaction product in an aqueous medium of a mixture comprising a silsesquioxane polymer and a amine-free surface treated zinc antimonate and an acid scavenger.

16 Claims, 2 Drawing Sheets

SOL GEL OVERCOATS INCORPORATING ZINC ANTIMONATE NANOPARTICLES

FIELD OF THE INVENTION

The present invention is related to electrophotography and, more particularly, to photoreceptors having silsesquioxane overcoats that contain amine-free surface treated zinc antimonate

BACKGROUND OF THE INVENTION

Charge transporting elements have a support and a charge transport layer that charge moves across. Charge transporting elements include antistatic elements and charge generating elements. Antistatic elements have an antistatic layer, which transports charge to prevent charge build up on the surface of the element.

In charge generating elements, incident light induces a charge separation across various layers of a multiple layer device. In an electrophotographic charge-generating element, also referred to herein as an electrophotographic element, an electron-hole pair produced within a charge-generating layer separate and move in opposite directions to develop a charge between an electrically conductive layer and an opposite surface of the element. The charge forms a pattern of electrostatic potential (also referred to as an electrostatic latent image). The electrostatic latent image can be formed by a variety of means, for example, by image wise radiation-induced discharge of a uniform potential previously formed on the surface. Typically, the electrostatic latent image is then developed into a toner image by contacting the latent image with an electrographic developer and the toner image is then fused to a receiver. If desired, the latent image can be transferred to another surface before development or the toner image can be transferred before fusing.

The requirements of the process of generating and separating charge place severe limitations on the characteristics of the layers in which charge is generated and holes and/or electrons are transported. For example, many such layers are very soft and subject to abrasion. More and more digital printers are being designed with higher resolution such as 1200 to 2400 (dots per inch) dpi. This requires a photoconductor that can resolve very small dots. For example, U.S. Pat. No. 7,289,751 discloses a charge generating element capable of resolving dots with 10 to 25 microns diameter. The disclosed charge generating element has a thickness of 4 to 8 microns. This places severe constraints upon the design of charge generating elements. Some configurations cannot provide a reasonable length of service unless an abrasion resistant overcoat layer is provided over the other layers of the element. This presents its own problems, since charge must be able to pass through the overcoat.

The resistivity of an overcoat has major consequences in an electrophotographic system. If the overcoat has high resistivity, the time constant for voltage decay will be excessively long relative to the processing time for the electrophotographic element and the overcoat will retain a residual potential after photo discharge of the underlying photoreceptor. The magnitude of the residual potential depends upon the initial potential, the dielectric constants of the various layers and the thicknesses of each layer. A solution has been to reduce the thickness of the overcoat layer. Another solution is to provide an overcoat that is conductive. The overcoat must, however, not be too conductive. The electrophotographic element must be sufficiently electrically insulating in the dark so that the element neither discharges excessively nor allows an excessive migration of charge along the surface of the element. An excessive discharge ("dark decay") would prevent the formation and development of the electrostatic latent image. Excessive migration causes a loss of resolution of the electrostatic image and the subsequent developed image. This loss of resolution is referred to as "lateral image spread". The extent of image degradation will depend upon processing time for the electrophotographic element and the thicknesses and dielectric constants of the layers. It is, thus, desirable to provide an overcoat that is neither too insulating nor too conductive.

The triboelectric properties of the overcoat must be matched to the triboelectric properties of the electrophotographic toner used to develop the electrostatic latent image. If the triboelectric properties are not matched, the electrophotographic element will triboelectrically charge against the electrophotographic toner. This causes disruption of the charge pattern of the electrostatic latent image and results in background in the resulting toner image. For example, an overcoat can triboelectrically match a particular negatively charging toner, but not triboelectrically match another toner that charges positively.

Silsesquioxanes are siloxane polymers, sometimes represented by the formula $(RSiO_{1.5})_x$, that are commonly prepared by the hydrolysis and condensation of trialkoxysilanes. U.S. Pat. No. 4,027,073 to Clark teaches the use of silsesquioxanes as abrasion resistant coatings on organic polymers. Typical applications include scratch resistant coatings on acrylic lenses and transparent glazing materials. This patent teaches that a preferred thickness for good scratch resistance is from 2 to 10 micrometers. U.S. Pat. No. 4,439,509 to Schank teaches photoconducting elements for electrophotography that have silsesquioxane coatings. The silsesquioxane overcoats have a thickness of from 0.5 to 2.0 micrometers. The patent indicates that this thickness optimizes electrical, transfer, cleaning and scratch resistance properties. This contrasts with U.S. Pat. No. 4,027,073, which teaches that a preferred thickness of a silsesquioxane layer, for good scratch resistance, is from 2 to 10 micrometers. U.S. Pat. No. 4,923,775 to Shank teaches that methylsilsesquioxane is preferred since it produces the hardest material in comparison to other alkylsilanes.

U.S. Pat. No. 4,595,602 to Schank teaches a conductive overcoat of cross-linked "siloxanol-colloidal silica hybrid" having a preferred thickness of from 0.3 to 5.0 micrometers. Cross-linkable siloxanol-colloidal silica hybrid was reacted with hydrolyzed ammonium salt of an alkoxy silane. The patent states:

> "the ionic moiety of the ammonium salt of an alkoxy silane is both uniformly distributed throughout the over coating and permanently anchored in place thereby providing sufficient and stable electrical conductivity characteristics to the over coating under a wide range of temperature and humidity conditions." (col. 6, lines 45-51)

Solid electrolytes, also referred to as solid ionic conductors, are solid materials in which electrical conductivity is provided by the motion of ions not electrons. A variety of solid electrolytes are inorganic crystals. Others are complexes of an organic polymer and a salt, such as complexes of poly (ethylene oxide) and alkali metal salt. "Electrolytes Dissolved in Polymers", J. M. G. Cowrie et al, Annu. Rev. Phys. Chem., Vol. 40, (1989) pp. 85-113 teaches various solid electrolytes. "Solid Ionic Conductors", D. F. Shriver et al, Chemical and Engineering News, Vol. 63, (1985) pp. 42-57; teaches a number of solid electrolytes including a salt-polyphosphazene complex. "Polymer Electrolytes", J. S. Tonge et al, Chapter 5, Polymers for Electronic Applications, ed. J. H. Lai, CRC Press, Boca Raton, Fla., 1989, pp. 157-210, at 162; teaches solid electrolytes having highly flexible, low $T_g$ siloxane backbones. "Fast Ion Conduction in Comb Shaped Polymers", J. M. G. Cowrie, Integration of Fundamental Polymer Science and Technology, Vol. 2, Elsevior Publ., New York, (1988), pp. 54-62; also teaches a solid electrolyte having a siloxane backbone. Electrical surface conductivities for polymeric and inorganic solid ion conductors are in the range of about $1\cdot10^{8\ to\ 10}$ (ohms/sq)$^{-1}$. (Surface conductivity is equal to conductivity divided by thickness and is expressed as (ohms/square)$^{-1}$. Surface resistivity is equal to resistivity divided by thickness and is expressed as ohms/square. For example, a resistivity of $1\cdot10^{14}$ ohms-cm, for a layer having a thickness of 5 microns, equates to a surface resistivity of $2\cdot10^{17}$. Solid electrolytes are used for applications including rechargeable lithium batteries, electrochemical sensors, and display devices. Polymeric solid electrolytes tend to be soft materials with little mechanical integrity.

Ferrar et al in U.S. Pat. No. 5,874,018 describe over coated charge transporting elements and glassy solid electrolytes. The charge-generating element has an electrically conductive layer, a charge-generating layer overlying the electrically conductive layer, and a layer of glassy solid electrolyte overlying the electrically conductive layer. The glassy solid electrolyte includes a complex of silsesquioxane and a charge carrier. The complex has a surface resistivity from about $1\cdot10^{10}$ to about $1\cdot10^{17}$ ohms/sq. The complex has a $T^2$ silicon: $T^3$ silicon ratio of less than 1 to 1. The complex has a ratio of carbon atoms to silicon atoms of greater than about 1.2 to 1.

These compositions will tend to be environmentally sensitive given the ionic nature of the conduction.

Ferrar et al in U.S. Pat. No. 6,517,984 silsesquioxane compositions containing tertiary arylamines for hole transport. An electrophotographic element includes: an electrically conducting layer, a charge generating layer overlying the electrically conducting layer, and a charge transport layer overlying the electrically conducting layer. The charge transport layer, which can be an overcoat overlying the charge generating layer, includes the reaction product in an aqueous medium of a mixture comprising a silsesquioxane polymer and a hole transport compound that comprises a tertiary arylamine containing at least one alcoholic or one phenolic hydroxy substituent.

Transport in tertiary aryl amines can be limited in highly crosslinked matrices, or sensitive to very low level of traps.

The disclosures of all the patents and other publications cited in the Background of the Invention are incorporated herein by reference.

It is an object of the present invention to provide an electrophotographic element with very low wear rate.

It is another object of the present invention to provide an electrophotographic element with low wear rate and low tendency for scumming.

It is yet another object of the present invention to provide an electrophotographic element with low wear rate, low tendency for scumming, and stable under all environmental conditions.

It is a further object of the present invention to provide an electrophotographic element with thickness that can accommodate high resolution printing such as 1200 to 2400 dpi.

SUMMARY OF THE INVENTION

The present invention is directed to an electrophotographic element that comprises: an electrically conducting layer, a charge generating layer overlying the electrically conducting layer, and a charge transport layer overlying the electrically conducting layer. The charge transport layer, which can be an overcoat overlying the charge generating layer, includes the reaction product in an aqueous medium of a mixture comprising a silsesquioxane polymer and an amine-free surface treated zinc antimonate and an acid scavenger.

Figure 1:
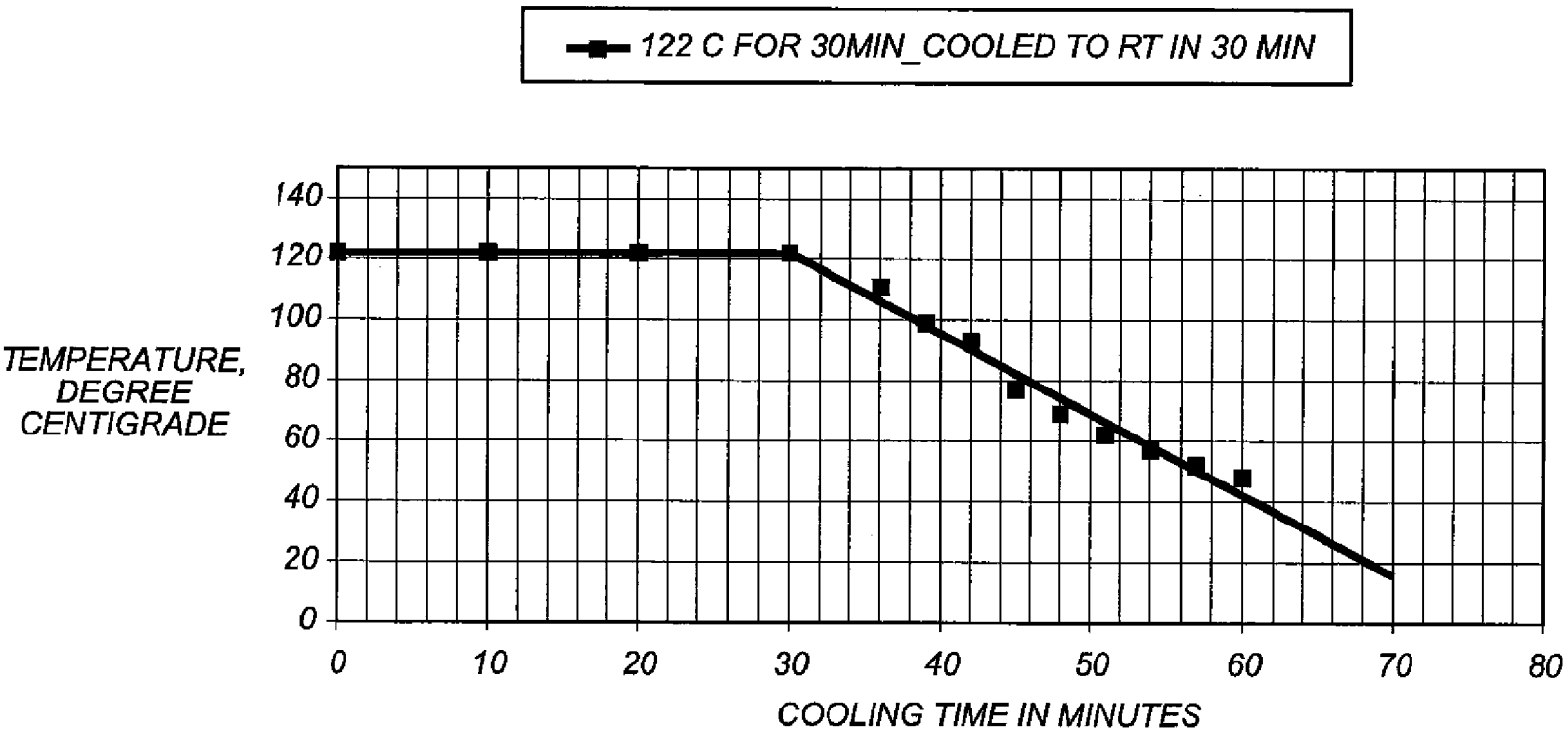
FIG. 1 is one cooling temperature profile of the examples shown in Table V.

For a better understanding of the present invention together with other advantages and capabilities thereof, reference is made to the following description and appended claims in connection with the preceding drawings.

DETAILED DESCRIPTION OF THE INVENTION

The present invention relates to new abrasion resistant layers incorporating amine-free surface treated zinc antimonate agents that are compatible with silsesquioxanes. The new layers also have the advantage being humidity insensitive because their conductivity is electronic and not ionic. Thus, unlike prior art ion-conducting silsesquioxane layers, they do not suffer from image degradation resulting from lateral image spread at high humidity. The overcoats, which preferably have a thickness of about 0.5 to 10 microns, more preferably, about 1 to 3 microns, can be coated from a variety of aqueous solvents. In applications where high resolution such as 1200 to 2400 dpi is desired, the thickness of the overcoats is minimized such that the total thickness of the charge generating element is between 3 and 12 microns, preferably between 4 and 8 microns.

The silsesquioxane polymer employed in the present invention is the product of the hydrolysis and condensation of at least one alkyltrialkoxysilane having the structure $$R^1\text{—Si—}(OR)_3$$

wherein R is an alkyl group containing 1 to about 4 carbon atoms, and $R^1$ is an aliphatic, cycloaliphatic, or aromatic group containing 1 to about 12 carbon atoms. Groups represented by $R^1$ can include substituent or connective moieties such as ethers, amides, esters, arylene, and the like. Preferably, however, $R^1$ is selected from the group consisting of alkyl or fluoroalkyl containing 1 to about 12 carbon atoms, cycloalkyl containing 5 to about 12 carbon atoms, and aryl containing 6 to about 12 carbon atoms. More preferable $R^1$ groups are alkyl groups containing 1 to about 3 carbon atoms, methyl being particularly preferred.

Silsesquioxanes, which are generally prepared by the hydrolysis and condensation of methyltrimethoxysilane (Scheme 1, R=—$CH_3$), are commercially available from various sources. For example, from Dow Corning as VESTAR Q9-6503, from General Electric as SHC 1010, where SHC stands for Silicone Hard Coat, and, more recently, from Optical Technologies as ULTRASHIELD, a hard coat that is specifically designed for photoreceptors.

Scheme 1

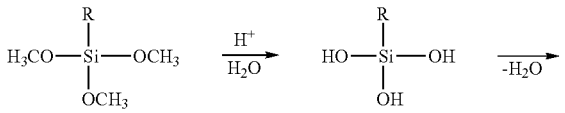

-continued

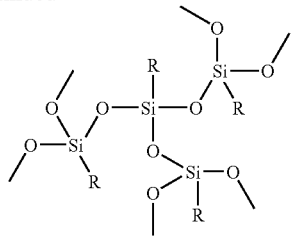

As disclosed in the above-mentioned U.S. Pat. Nos. 5,731,117 and 5,693,442, propyltrimethoxysilane has been introduced to make the sol-gel more organic in character, and glycidoxy ether substituted silane has been used to complex with lithium iodide for conductivity. A silsesquioxane produces a photoreceptor overcoat that is more resistant to corona, which is probably the result of an increase in hydrophobic character of the sol-gel due to an increase in the organic content.

In accordance with the present invention, a silsesquioxane-over coated photoreceptor is rendered resistant to charge build up during cycling by the incorporation of a amine-free surface treated zinc antimonate agents, thereby avoiding the lateral image spread that has been observed for the solid electrolyte silsesquioxane under conditions of high humidity. The amine-free surface treated zinc antimonate agents are simply added to the alcoholic solution of sol-gel before coating in any desired amount up to about 60 weight percent.

The acid scavenger can have functional groups that can be reacted to provide covalent linkage to the silsesquioxane polymer matrix. Such functional groups include, but are not limited to, hydroxy, oxycarbonylalkyl (such as acetoxy and propionoxy), isocyanato, epoxy, amino (primary or secondary) and silicon ester groups, that are located in a suitable place in the acid scavenger molecule as would be apparent to a skilled worker using the teaching of representative molecules provided below. These reactive functional groups can be used to react the acid scavenger to any suitable portion of the silsesquioxane polymer matrix, as would be readily apparent to a skilled artisan.

Other means for limiting diffusibility would be readily apparent to one skilled in the art.

The compounds used as acid scavengers in this invention are also "basic" in nature and, thus, generally have a pKa of at least 4 in water. Preferably, the pKa is from about 4 to about 10, and more preferably it is from about 4 to about 8.

The acid scavenger (or mixture thereof) is present in the overcoat in an amount of at least 0.2 weight %, preferably in an amount of from about 0.5 to about 50 weight %, and more preferably in an amount of from about 1 to about 30 weight %. These weight percentages are based on the total overcoat dry weight.

Representative acid scavengers are tertiary arylamines that can be described with Structure V:

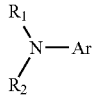

wherein $R_1$ and $R_2$ are independently substituted or unsubstituted hydrocarbon groups, other than aryl groups, having from 1 to 12 carbon atoms, and Ar is a substituted or unsubstituted carbocyclic aromatic group. Preferably, Ar is substituted as described in more detail below.

Still further, the acid scavengers can be represented by Structure VI:

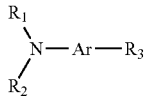

wherein $R_1$, $R_2$ and Ar are as defined above for Structure V, and $R_3$ is hydrogen, halo, or a substituted or unsubstituted organic group.

More particularly, $R_1$ and $R_2$ are independently substituted or unsubstituted alkyl groups having 1 to 12 carbon atoms (such as methyl, ethyl, n-propyl, isopropyl, t-butyl, hexyl, benzyl, hydroxymethyl, 2-hydroxyethyl, 2-aminoethyl, and 2-mercaptoethyl), substituted or unsubstituted cycloalkyl groups having 5 to 6 carbon atoms in ring systems having one or more rings (such as cyclopentyl, cyclohexyl, 4-hydroxycyclohexyl and 4-aminocyclohexyl), substituted or unsubstituted alkenyl groups having 2 to 10 carbon atoms (such as ethenyl, 1,2-propenyl, geranylamine, geranyl chloride and geranyl bromide), or substituted or unsubstituted alkynyl groups having 2 to 10 carbon atoms (such as ethynyl, 1,2-propynyl, 5-hexynenitrile and 3-hexyn-1-ol). $R_1$ and $R_2$ can also be a hydrocarbon group having a combination of alkyl, alkenyl, alkynyl and cycloalkyl groups as defined above. Neither $R_1$ nor $R_2$ is a carbocyclic aryl group.

In addition, $R_1$ and $R_2$ together can represent the carbon, oxygen, nitrogen and sulfur atoms necessary to complete a 3- to 10-membered ring with the nitrogen atom in either structure V or VI. Such rings can be saturated or unsaturated.

Preferably, $R_1$ and $R_2$ are independently a substituted or unsubstituted alkyl groups each having 1 to 4 carbon atoms, and more preferably, each of them is a substituted or unsubstituted alkyl group having 1 to 3 carbon atoms. Most preferred alkyl groups are substituted or unsubstituted methyl, ethyl and n-propyl groups. It is also preferred that at least one of $R_1$ and $R_2$ be substituted with at least one hydroxy, alkylcarboxy, isocyanato, epoxy, amino or silicon ester functional group as described above (more preferably, a hydroxy group).

In Structure V and Structure IV identified above, Ar is a carbocyclic aryl group that can have one or more substituents as defined herein. Preferably, Ar has only one substituent as defined in more detail below. Generally, Ar is phenyl, naphthyl or anthryl that can have one or more substituents. Ar can also include one or more solubilizing groups as defined above, but such functional groups must be connected to Ar through a nonaromatic hydrocarbon group (such as an alkyl group having 1 to 4 carbon atoms as defined above for $R_1$ and $R_2$), or a secondary or tertiary amine (such as mono- or dialkylamino group wherein each alkyl portion has 1 to 4 carbon atoms). Preferably, any such functional group that is connected to Ar is a hydroxy group. The more preferred Ar groups are substituted or unsubstituted phenyl groups.

The $R_3$ group in Structure VI can be hydrogen, halo (such as chloro, bromo or fluoro), or a substituted or unsubstituted organic group that has a molecular weight of at least 50 and can include one or more carbocyclic aryl groups, cycloalkyl groups, alkyl groups, alkenyl groups, alkynyl groups, aromatic or non-aromatic heterocyclic groups, or combination of any these (such as a carbon atom substituted with an alkyldiaryl group, a dialkylaryl group or a trialkyl group). Particularly useful $R_3$ groups include triarylmethyl groups (such as triphenylmethyl, tritolylmethyl and tolyldiphenylmethyl). It is also possible that the $R_3$ group can include one or more hydroxy, alkylcarboxyl, isocyanato, epoxy, amino or silicon ester functional groups as identified above, and preferably such groups are connected to $R_3$ (where for example, $R_3$ is a triarylmethyl group) through a mono or dialkylamino group (as defined above for Ar), or through a hydrocarbon linkage having 1 to 12 carbon atoms. Hydroxy is a most preferred functional group in this context. A wide variety of useful $R_3$ groups could be designed by a skilled worker in the art to accomplish the desired purposes.

Several representative acid scavengers are identified below by structures. Acid Scavenger I is the most preferred in the practice of this invention.

ACID SCAVENGER I

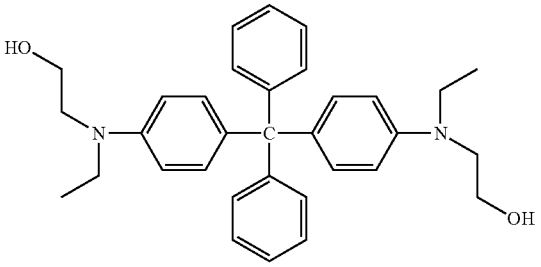

ACID SCAVENGER II

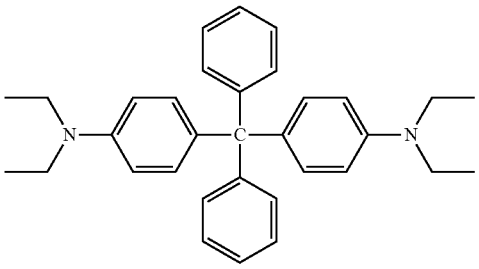

ACID SCAVENGER III

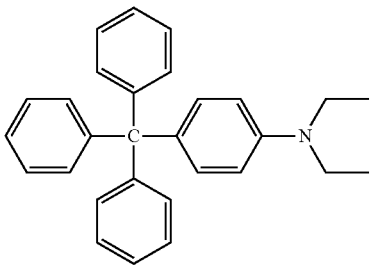

ACID SCAVENGER IV

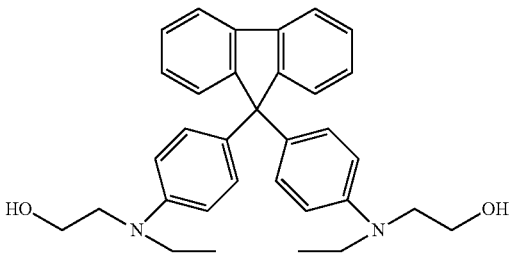

-continued

ACID SCAVENGER V

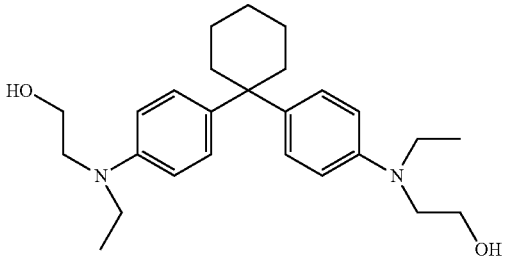

ACID SCAVENGER VI

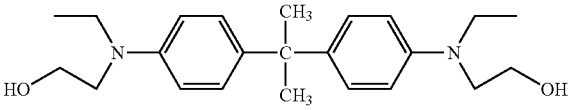

ACID SCAVENGER VII

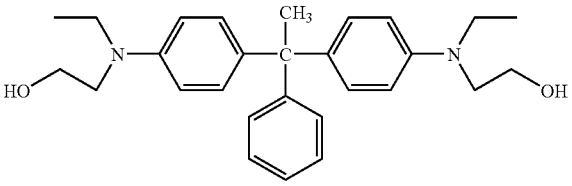

ACID SCAVENGER VIII

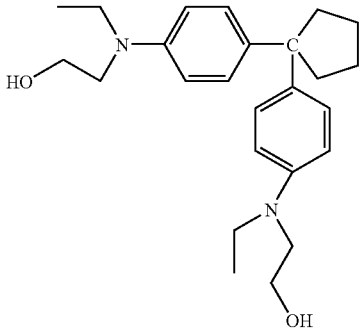

The zinc antimonate compositions of the present invention are obtained from Nissan Chemicals under the tradename CELNAX™.

CELNAX™ is a colloidal electro-conductive zinc antimonate solution having good infrared and ultraviolet-absorbing properties. It is compatible with several resins and stabilizing agents and has excellent transparency qualities.

Typically, CELNAX™ dispersions are stabilized using an aliphatic amine. The presence of aliphatic amines in photoconductive elements can be problematic. Aliphatic amines usually have low oxidation potentials and tend to act as traps in photoreceptors. That results in high initial and increased toe on electrical cycling.

To overcome this problem, we have found that eliminating the amine stabilizer and treating the zinc antimonate with amorphous silica help provide non-trapping and well dispersed zinc antimonate dispersions.

The hydrolysis and condensation of the silanes are catalyzed by colloidal silica, silica particles that are stabilized by either an acidic or basic surface charge and exert a significant influence on the mechanical properties of the silsesquioxane coating. Preferably, up to about 20 weight percent of the colloidal silica, based on the amount of alkyltrialkoxysilane, is added to the mixture. More preferably, the amount of added silica is about 5 to about 10 weight percent, based on the silsesquioxane. A preferred colloidal silica, stabilized with a small amount of sodium oxide, is LUDOX™ LS, available from DuPont. When the volatile acetic acid, methanol and other solvents in the sol-gel are removed, the sodium oxide remains to act as a condensation catalyst for the formation of the silsesquioxane. The silsesquioxane network forms through Si—O—Si linkages, while the hydroxysubstituted CTMs would be expected to condense to form part of the siloxane network through Si—O—C linkages. Other bases such as hydroxides or acetates of alkali and alkaline earth metals are also appropriate catalysts for the hydrolysis and condensation in place of the colloidal silica. However, bases such as aminosilanes that interfere with hole transport through a polymer network doped with organic photoreceptor molecules would also be expected to interfere with hole transport through the silsesquioxane network and would, therefore, not be preferred in the practice of this invention.

In a typical procedure, methyltrimethoxysilane is acidified with acetic acid and hydrolyzed with approximately 2.5 equivalents of water. The solution is then diluted with either ethanol or isopropanol, the LUDOX™ LS colloidal silica is added, and up to 40 weight percent of an organic co-solvent such as methyl isobutyl ketone (MIBK) is added to help dissolve the hydroxyl-substituted acid scavenger, which is then added at a desired level. The hydroxyl-substituted acid scavengers are soluble in the solvents used to prepare the silsesquioxane, giving clear films when coated over photoreceptor at up to 60 weight percent loadings.

The following examples illustrate the present invention:

Formulation 1: Zinc Antimonate screening.

To screen the various zinc antimonate the following formulation was used:

| | |
|---|---|
| Polymethyl methacrylate: | 34 wt % |
| CELNAX ™ conductor: | 55 wt % |
| Crosslinker: | 11 wt % |
| Solvent: | Dowanol PM |
| Percent Solid: | 6% |

Each formulation, containing a particular zinc antimonate dispersion was used to overcoat a photoreceptor drum coated as described in Molaire et al published U.S. Patent Application 2007/0042282 entitled "Condensation Polymer Photoconductive Elements". The coated drums were then evaluated using a PDT-1000 drum sensitometer obtained from QEA Inc. The results in Table I show that Example 1 exhibits substantially lower initial toe than Comparative Examples 2 and 3.

Formulation 2: Plain Sol Gel Formulation

A 1-liter sol-gel formulation was prepared in a two liter round bottom flask as follows:

Glacial acetic acid (70.3 grams) was added drop wise to methyltrimethoxysilane (305.6 g, 2.24 mol), and LUDOX™ LS (67 grams), and the reaction mixture was stirred overnight. The acidified silanes were then hydrolyzed by the drop wise addition of water (48 grams, 2.67 mol) and the reaction mixture was stirred overnight. It was then diluted to approximately 24.6 weight percent solids by the drop wise addition of isopropanol (523 grams) and methyl ethyl ketone (252 grams). The clear solution was stirred for one week before filtration through a 0.4 micron glass filter and stored at 4° C. Before coating, the solution was further diluted with 1766 grams of isopropanol to 10.3% solids.

Formulation 3: Sol Gel formulation Containing 40% CELNAX™ CX-Z200DIP-F(C1)

To 2700 grams of Formulation 2, 506 grams of CELNAX™ CX-Z200DIP-F(C1), a 22 weight percent zinc antimonate isopropanol dispersion obtained from Nissan Chemicals. The zinc antimonate was surface treated with amorphous silica. The dispersion was made completely free of amine.

Formulation 4: Sol Gel Formulation containing 40% CELNAX™ CX-Z200DIP-F(C1) and Diol Tertiary Amine Acid Scavenger To Formulation 3, 20 grams of 9,9-bis[N-ethyl-N-(2-hydroxyethyl)anilino]fluorene were added with stirring to yield a 10 weight percent of acid scavenger based on sol gel solids.

Effect of Zinc Antimonate

Formulations 2 and 4 were respectively used to overcoat a photoreceptor drum coated as described in Molaire et al published U.S. Patent Application 2007/0042282 "Condensation Polymer Photoconductive Elements" The over coated drums

TABLE I

Screening of Zinc Antimonate Dispersions

| | Zinc Antimonate Dispersion | Material | pH | Oxide Wt % | Volume Resistivity Ohm's | Dispersion Medium | Amine ppm | (SiO2)n Wt % | Tin Oxide Wt % | Discharged Voltage |
|---|---|---|---|---|---|---|---|---|---|---|
| Comparative Example 1 | CELNAX ™ CX-Z641M | Zinc Antimonate Methanolsol | 9.4 | 60.6 | 188 | Methanol | 2518 | None | None | 106 |
| Comparative Example 2 | CELNAX ™ CX-Z210IP | Zinc Antimonate Isopropanolsol | 5.5 | 21.2 | 243 | Isopropanol | 2518 | None | None | 67 |
| Example 1 | CELNAX ™ CX-Z200DIP-F(C1) | Zinc Antimonate Isopropanolsol | 3.4 | 20.6 | 9072 | Isopropanol | None | 1.8 | 0.4 | 23 |

were first evaluated after curing in a Blue M oven at 120° C. The drums were further cured at 130° C. and evaluated again twenty-four hours after the initial curing. Table II compares the discharged toe for the bare drums, and the over-coated drums after curing at 120° C. and at 130° C. respectively. The toe for the zinc antimonate containing overcoat is about 50% lower.

TABLE II

Effect of Zinc Antimonate

| | Formulation | Bare PC Discharge Voltage Before overcoat | Over coated PC Cured @ 120° C. Discharge Voltage | Over coated PC Cured @ 130° C. Discharge Voltage |
|---|---|---|---|---|
| Comparative Example 2 | Plain Sol Gel | 25 | 82 | 88 |

TABLE II-continued

Effect of Zinc Antimonate

| | Formulation | Bare PC Discharge Voltage Before overcoat | Over coated PC Cured @ 120° C. Discharge Voltage | Over coated PC Cured @ 130° C. Discharge Voltage |
|---|---|---|---|---|
| Example 2 | Sol Gel Plus 40% CELNAX ™ CXZ210IP-F(C-1) Plus 10% OPDiol | 26 | 42 | 41 |

Effect of Curing Temperature

The bare drums of Example 2 and Comparative Example 3 were coated weeks before the overcoat experiment. To fully identify the effect of curing, another experiment was performed including side-by-side curing of bare and over-coated drums with sequential curing at 90° C., 100° C., 110° C. and 120° C. The drums were evaluated twenty-four hours after each curing cycle

TABLE III

| | Formulation | Bare PC Discharge Voltage before overcoat | PC Cured @ 90° C. Discharge Voltage | PC Cured @ 100° C. Discharge Voltage | PC Cured @ 110° C. Discharge Voltage | PC Cured @ 120° C. Discharge Voltage |
|---|---|---|---|---|---|---|
| Comparative Example 4 | No Overcoat Drum | 25 | 39 | 38 | 40 | 40 |
| Example 3 | Sol Gel Plus 40% CELNAX ™ CXZ210IP-F(C-1) Plus 10% OPDiol | 24 | 44 | 44 | 51 | 51 |

Effect of Acid Scavenger 9,9-bis[N-ethyl-N-(2-hydroxyethyl)anilino]fluorene Concentration on Sol Gel Cracking Formulation 4 was modified with 2.5, 5, and 10 weight percent of the acid scavenger 9,9-bis[N-ethyl-N-(2-hydroxyethyl)anilino]fluorine respectively, as shown in Table IV. The overcoat layers were examined for cracking after curing at 120° C. as a function of overcoat thickness. The results of Table IV show no cracking for layers thinner than 6 microns with the concentration of the scavenger at 10 weight percent. At 5 weight percent, scavenger cracking is seen even for overcoat layer above 1.5 microns thick while the cracks are larger than 10 weight percent scavenger. At 2.5 weight percent scavenger the cracks are larger.

It is postulated that the incorporation of the organic acid scavenger through its alcohol functionality render the sol gel matrix less brittle and more resistant to residual cooling induced stress. It is postulated that other alcohol containing organic materials capable of softening the sol gel matrix will behave similarly.

TABLE IV

| | Formulation % Solid | OP Diol Concentration | Coating Speed mm/sec | Coating passes | Overcoat Thickness in microns | Coating Cracks Size, microns |
|---|---|---|---|---|---|---|
| Comparative Example 4 | 33% | 2.5% | 2.5 | 1 | 3 | 6 |
| Comparative Example 5 | 33% | 2.5% | 2.5 | 2 | 6 | 18 |
| Example 4 | 33% | 5.0% | 1.5 | 1 | 1.5 | None |
| Comparative Example 6 | 33% | 5.0% | 2.5 | 1 | 3 | 5 |

TABLE IV-continued

| | Formulation % Solid | OP Diol Concentration | Coating Speed mm/sec | Coating passes | Overcoat Thickness in microns | Coating Cracks Size, microns |
|---|---|---|---|---|---|---|
| Comparative Example 7 | 33% | 5.0% | 2.5 | 2 | 6 | 8 |
| Example 5 | 28% | 10.0% | 2.5 | 1 | 0.5 | None |
| Example 6 | 28% | 10.0% | 2.5 | 1 | 0.6 | None |
| Example 7 | 28% | 10.0% | 2.5 | 2 | 1 | None |
| Example 8 | 33% | 10.0% | 1.5 | 1 | 1.5 | None |
| Example 9 | 33% | 10.0% | 2 | 1 | 2 | None |
| Example 10 | 33% | 10.0% | 2.5 | 1 | 3 | None |
| Comparative Example 8 | 33% | 10.0% | 2.5 | 2 | 6 | 3 |

Effect of Cooling Rate

Organic photoreceptors drums are often sensitive to thermal shock. That is when submitted to thermal cycling above the glass transition temperature of the layers if they are cooled rapidly (quenching), their electrophotographic response can be adversely affected. In particular, discharged toe tends to be higher than before the thermal cycling. Eventually, depending on the rate of cooling, an equilibrium toe will be reached with time.

Comparative Examples 9 and 10 of Table V demonstrate that phenomenon for a bare and a sol gel over coated drum respectively. The two drums were heated and cooled according to the temperature profile of FIG. 1. The electrophotographic measurements were made twenty-four hours after processing.

Figure 2:
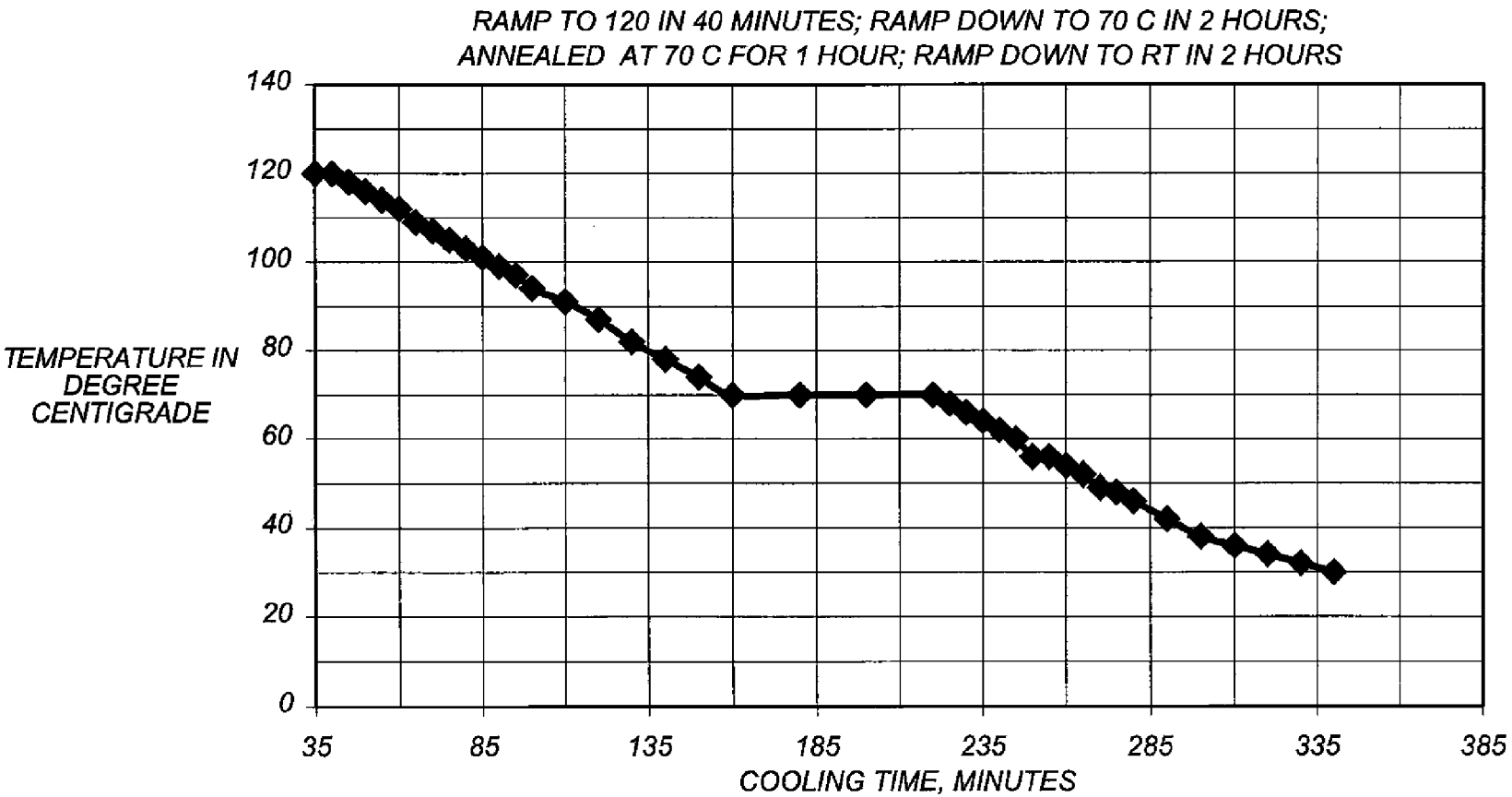
FIG. 2 is the preferred cooling temperature profile for the coating of the present invention.

To improve this situation curing experiments were run and it was found that the cooling profile in FIG. 2 where the samples are annealed at 70° C. for an hour followed by slow cooling to room temperature over a two hour period resulted in significantly improved discharged toe, and more rapid equilibrium recovery (Example 11).

TABLE V

| | Formulation | Cooling Profile | PC Cured @ 90° C. Discharge Voltage | PC Cured @ 100° C. Discharge Voltage | PC Cured @ 110° C. Discharge Voltage | PC Cured @ 120° C. Discharge Voltage |
|---|---|---|---|---|---|---|
| Comparative Example 9 | No Overcoat Drum | FIG. 1 | 62 | 70 | 82 | 79 |
| Comparative Example 10 | Sol Gel Plus 40% CELNAX ™ CXZ210IP-F(C-1) Plus 10% OPDiol | FIG. 1 | 70 | 81 | 86 | 86 |
| Example 11 | Sol Gel Plus 40% CELNAX ™ CXZ210IP-F(C-1) Plus 10% OPDiol | FIG. 2 | — | — | — | 41 |

The over coated photoconductor of Example 11 was mounted in a Nexpress 2100 tandem production printer in the cyan module with three control non-over coated drums on the other three modules. The press was run for over 300K prints with no observable difference in prints quality.

The invention has been described with reference to a preferred embodiment; however, it will be appreciated that variations and modifications can be implemented by persons of ordinary skill in the art without departing from the scope of the invention.

The invention claimed is:

1. An electrophotographic imaging member comprising a substrate, a charge generating layer, a charge transport layer, and an overcoat layer comprising the reaction product in an aqueous medium of a mixture comprising polydimethylsiloxane (PDMS), a silsesquioxane polymer, an amine-free surface treated zinc antimonate and a non-diffusible acid scavenger.

2. The electrophotographic imaging member of claim 1 where the zinc antimonate is surface treated with silica.

3. The electrophotographic element of claim 1 wherein said silsesquioxane polymer is the product of the hydrolysis and condensation of at least one alkyltrialkoxysilane having the structure $$R^1—Si—(OR_3)$$

wherein R is an alkyl group containing 1 to about 4 carbon atoms, and $R^1$ is an aliphatic, cycloaliphatic, or aromatic group containing 1 to about 12 carbon atoms.

4. The electrophotographic element of claim 3 wherein $R^1$ is selected from the group consisting of alkyl containing 1 to about 12 carbon atoms, fluoroalkyl containing 1 to about 12 carbon atoms, cycloalkyl containing 5 to about 12 carbon atoms, and aryl containing 6 to about 12 carbon atoms.

5. The electrophotographic element of claim 1 wherein said mixture further comprises colloidal silica.

6. The electrophotographic element of claim 1 wherein the total thickness of the charge generating element is between 3 and 30 microns.

7. The electrophotographic element of claim 1 wherein the total thickness of the charge generating element is between 5 and 8 microns.

8. The element of claim 1 wherein said non-diffusible acid scavenger has a pKa of from about 4 to about 10, and is present in said overcoat layer in an amount of from about 0.5 to about 50 weight percent.

9. The element of claim 8 wherein said non-diffusible acid scavenger has at least one hydroxy group, a pKa of from about 4 to about 8, and is present in said solid electrolyte layer in an amount of from about 1 to about 30 percent.

10. The element of claim 1 wherein said non-diffusible acid scavenger is represented by Structure V:

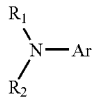

wherein $R_1$ and $R_2$ are independently substituted or unsubstituted hydrocarbon groups, other than aryl groups, having from 1 to 12 carbon atoms, or $R_1$ and $R^2$ together represent the carbon, oxygen, nitrogen and sulfur atoms necessary to complete a 3- to 10-membered ring with the nitrogen atom in Structure V, and Ar is a substituted or unsubstituted carbocyclic aromatic group.

11. The element of claim 10 wherein said non-diffusible acid scavenger is represented by Structure VI:

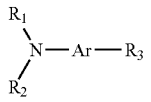

wherein $R_1$ and $R_2$ are independently substituted or unsubstituted hydrocarbon groups, other than aryl groups, having from 1 to 12 carbon atoms, or $R_1$ and $R_2$ together represent the carbon, oxygen, nitrogen and sulfur atoms necessary to complete a 3- to 10-membered ring with the nitrogen atom in Structure VI, Ar is a substituted or unsubstituted carbocyclic aromatic group, and $R_3$ is hydrogen, halo, or a substituted or unsubstituted organic group.

12. The element of claim 11 wherein $R_1$ and $R_2$ are independently substituted or unsubstituted alkyl groups having 1 to 12 carbon atoms, substituted or unsubstituted alkenyl groups having 2 to 10 carbon atoms, substituted or unsubstituted alkynyl groups having 2 to 10 carbon atoms, or substituted or unsubstituted cycloalkyl groups having 5 to 6 carbon atoms, or $R_1$ and $R_2$ together represent the carbon, oxygen, nitrogen and sulfur atoms necessary to complete a 3- to 10-membered ring with the nitrogen atom in Structure VI, Ar is a phenylene, naphthylene or anthrylene group, and $R_3$ is hydrogen, halo or a substituted or unsubstituted organic group having a molecular weight of at least 50 and includes one or more carbocyclic aryl groups, cycloalkyl groups, alkyl groups, alkenyl groups, alkynyl groups, aromatic or nonaromatic heterocyclic groups, or a combination of any of these.

13. The element of claim 12 wherein $R_1$ and $R_2$ are independently substituted or unsubstituted alkyl groups having 1 to 12 carbon atoms, and $R_3$ is a substituted or unsubstituted organic group having a molecular weight of at least 50, and at least one of $R_1$, $R_2$ and $R_3$ comprises a functional group selected from the group consisting of hydroxy, alkylcarboxy, isocyanato, epoxy, amino, and silicon ester.

14. The element of claim 12 wherein $R_1$ and $R_2$ are independently a substituted or unsubstituted alkyl group having 1 to 4 carbon atoms, and at least one of them comprises one or more hydroxy, alkylcarboxy, isocyanato, epoxy, amino or silicon ester groups, Ar is a phenylene group, and $R_3$ is a triarylmethyl group that can also include one or more hydroxy, alkylcarboxy, isocyanato, epoxy, amino or silicon ester groups.

15. The element of claim 1 wherein said non-diffusible acid scavenger is one of the following compounds:

ACID SCAVENGER I

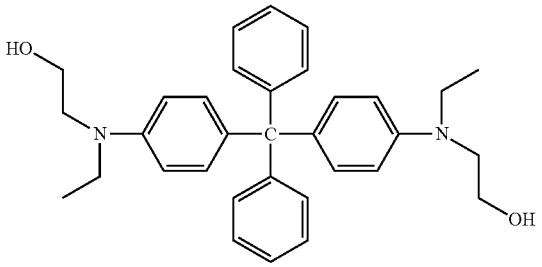

ACID SCAVENGER II

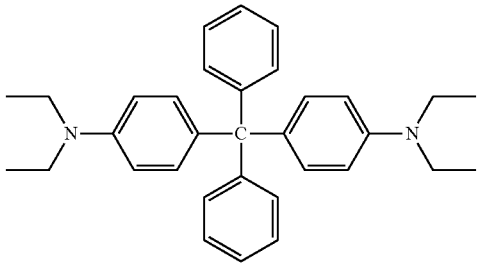

ACID SCAVENGER III

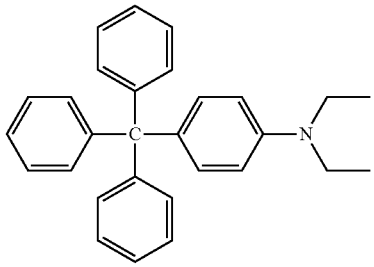

ACID SCAVENGER IV

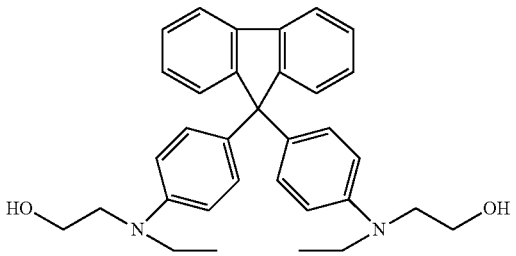

ACID SCAVENGER V

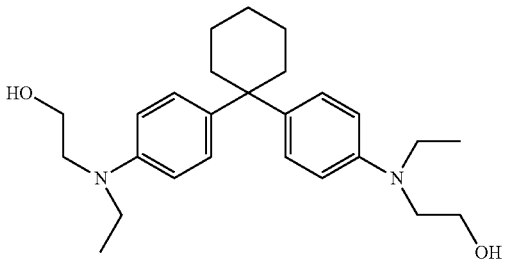

-continued
ACID SCAVENGER VI
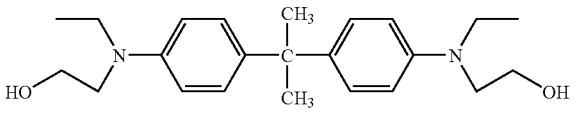
ACID SCAVENGER VII
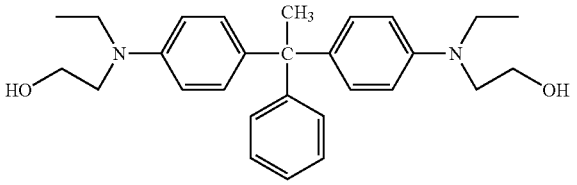
-continued
ACID SCAVENGER VIII
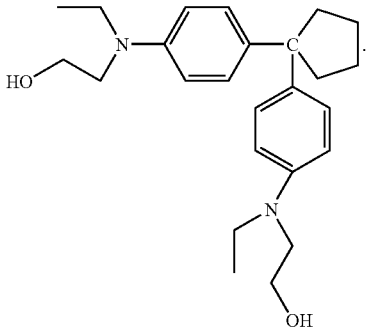
16. The element of claim 15 wherein said non-diffusible acid scavenger is one of the compounds ACID SCAVENGER I, ACID SCAVENGER IV or ACID SCAVENGER V.
* * * * *